United States Patent [19]

Brown et al.

[11] 4,112,150

[45] Sep. 5, 1978

[54] WATERPROOF SLIDE FASTENER

[76] Inventors: Michael A. Brown, 2909 Edgemoor La., Moraine, Ohio 45439; Steven F. Shade, 1000 Lookout Ter., Apt. C, West Carrollton, Ohio 45449

[21] Appl. No.: 623,040

[22] Filed: Oct. 16, 1975

Related U.S. Application Data

[62] Division of Ser. No. 425,888, Dec. 18, 1973, Pat. No. 3,914,827.

[51] Int. Cl.[2] ..... B05D 5/00

[52] U.S. Cl. ..... 427/284; 427/294; 427/295; 427/296

[58] Field of Search ..... 427/284, 295, 294, 296; 24/205.13 D, 205.1 C

[56] References Cited

U.S. PATENT DOCUMENTS

| | | | |
|---|---|---|---|
| T857,046 | 12/1968 | Eels et al. | 427/294 X |
| 1,719,856 | 7/1929 | Sipe | 24/205.13 D |
| 1,929,083 | 10/1933 | Sipe | 24/205.13 D |
| 2,016,316 | 10/1935 | Collins | 427/284 |
| 2,079,563 | 5/1937 | Reuter | 427/284 |
| 2,684,307 | 7/1954 | Knapman | 427/295 |
| 3,035,956 | 5/1962 | Gonda | 24/205.1 C |
| 3,389,441 | 6/1968 | Heimberger | 24/205.1 C |
| 3,490,109 | 1/1970 | Heimberger | 24/205.1 C |
| 3,514,314 | 5/1970 | Nemeth | 427/295 |
| 3,937,855 | 2/1976 | Gruenwald | 427/294 |

*Primary Examiner*—Ronald H. Smith
*Assistant Examiner*—Janyce A. Bell
*Attorney, Agent, or Firm*—Jerome P. Bloom

[57] ABSTRACT

A waterproof slide type fastener or zipper assembly featuring side by side tape means the adjacent edges of which mount cooperatively designed interlocking loops or coils wherein the tapes and loops are coated and filled with a resilient material in the nature of a room temperature vulcanizable silicone rubber compound. The arrangement is such that the interlocking of the loops on the respectively adjacent edges of the tapes, through the medium of a slide type closure element, causes a compression and sealing adherence of the contained resilient material which forms a releasable but positive seal and bond between the parts. The energy stored in the compression of the resilient material insures against passage of water in the vicinity of the interlocking loops while permitting their ready separation, as and when required.

The invention also contemplates a simple and inexpensive way of using vacuum to apply the resilient material to the loops or coils and their connected tapes.

9 Claims, 8 Drawing Figures

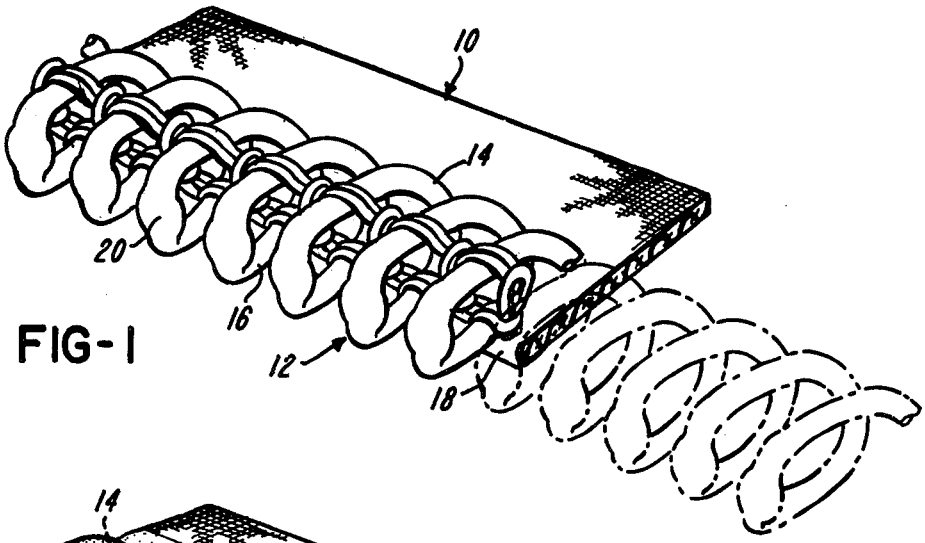
FIG-1
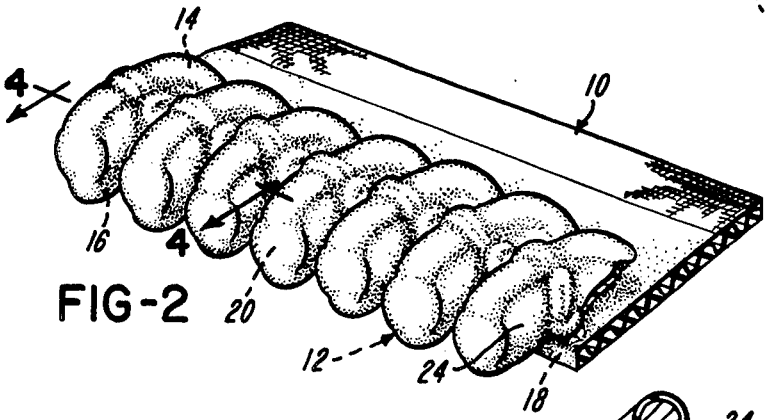
FIG-2
FIG-3
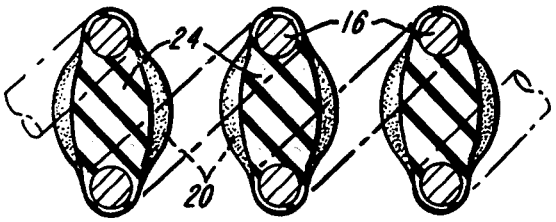
FIG-4
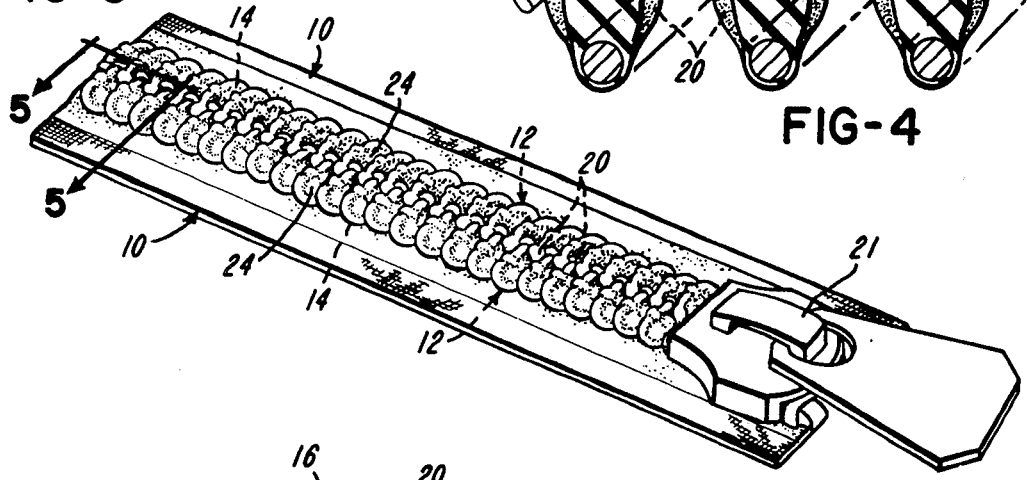
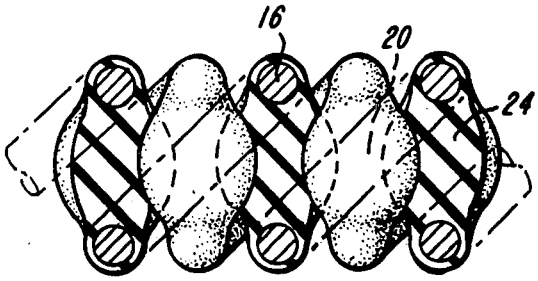
FIG-5

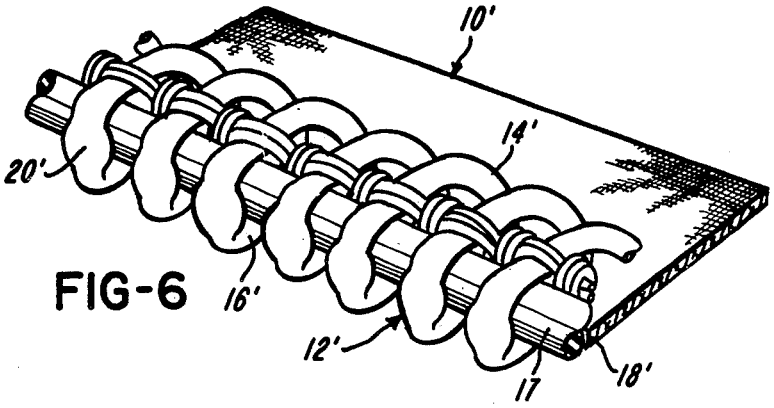
FIG-6
FIG-7
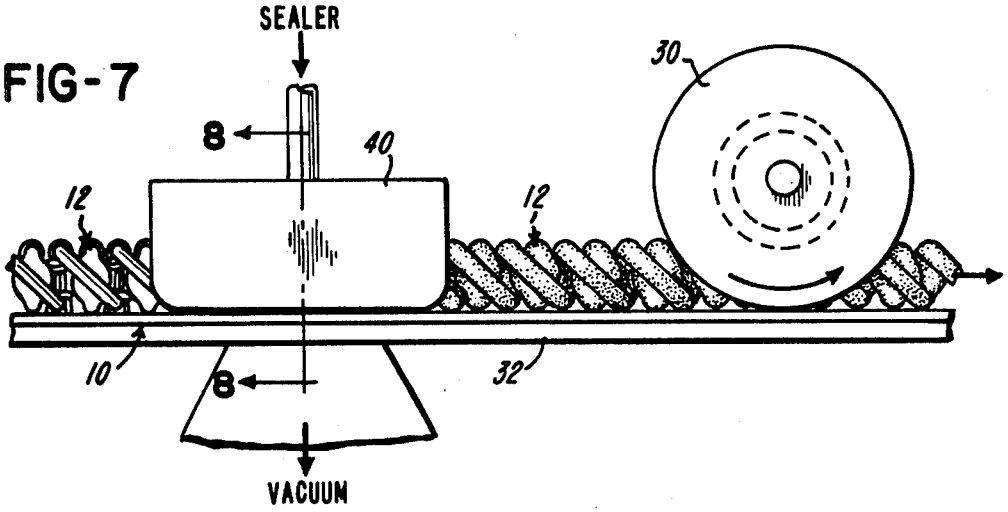
FIG-8
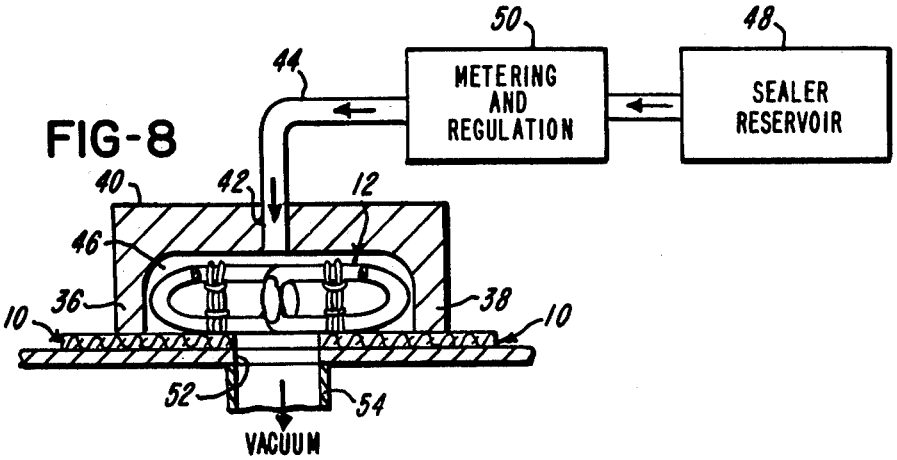

WATERPROOF SLIDE FASTENER

This application is a division of applicants co-pending application Ser. No. 425,888, filed Dec. 18, 1973, and now U.S. Pat. No. 3,914,827.

BACKGROUND OF THE INVENTION

This invention relates to a new and improved waterproof slide type fastener or zipper assembly utilizing interlocking coil or loop type connecting elements.

The ease of manipulation and the relative security of slide type fasteners has led to their widespread use in suits as well as other garments, casings and coverings associated with "in water" and underwater activities. It has been found, however, that such fastener assemblies do not per se seal against the passage of water due to the necessary configuration of their interlocking digit-like connector portions, as well as the holes produced in their connection to supporting tapes. The zipper or slide type fastener assembly has proven to be particularly difficult to economically modify so as to effectively become and stay "waterproof" in its closed condition, particularly after repeated usage.

It has been known in the prior art to form dust covers over slide type fasteners. Such dust covers do not, however, provide a seal against the passage of water. They tend to be readily displaced from their covering position, particularly when in a turbulent water environment.

A slide type fastener has also been known and developed wherein a two-part overlay forms a seal by reason of interlocking edges. While this concept has been applied to specialized equipment, it is not an economical solution to the problem posed and does not make the slide type fastener per se impervious to the passage of water. Embodiments are impractical for general production or wide-spread usage. Moreover, when one has to create a separate cover for a slide type fastener or zipper assembly, there is both an increase in cost and a waste of material. This does not answer the general needs for an inexpensive and easily produced slide type fastener which is capable of affording, in its closed position, a seal against passage of water.

SUMMARY OF THE INVENTION

The present invention provides improvements in slide or zipper type closure or fastener assemblies rendering them capable, in their closed condition, of preventing the passage of water, even where the water is turbulent and under considerable pressure.

Preferred embodiments of the invention comprise a zipper type fastener which is basically comprised of tape segments attachable to adjacent edge portions of an opening in a garment, container or casing, wherein the adjacent edges of the tape segment mount slide manipulated coil or loop type connector portions characterized by a filler and cover of resilient material in the nature of a room temperature vulcanized rubber sealant. The filler and cover material is such and so arranged that as the loop or coil type connector portions are brought into their interlocking closed positions by conventional slide element, the resilient material, which has a web relation to the loops or coils, is placed under compression and adheres, one portion to the other, to form a seal and a bond between the interrelated parts. In applying this resilient material in accordance with the invention, the tapes per se are similarly filled. It is a characteristic of the invention embodiment as the loops or coils are caused to separate, by appropriate movement of their slide type controller, the energy stored in the resilient filler and coating material lends itself to inducing their clean and quick release. Thus, a seal is provided which will accommodate repeated opening and closing of the slide type fastener without diminishing its capacity to prevent the passage of water in a closed condition.

Once the loop or coil type connector elements of the slide fastener assembly are attached to their respective supporting tapes and thus provided in strip form, a slide type closure in accordance with the invention may be completed in simple fashion. In a preferred procedure, the tape strips and their related connector coils or loops are conveyor fed through a chamber in an overlying shoe. As the strips move, this chamber is fed with a room temperature vulcanizable silicone rubber compound which is caused to flow to and through the coils or loops and their attached tapes under the influence of an applied vacuum. In the course of this procedure the coils or loops are webbed, filled and coated and each supporting tape is impregnated and all of its openings filled. It is noted that the strips can be fed individually or as an assembly in the open condition thereof.

A primary object of the invention is to provide an improved slide type fastener capable in the closed condition thereof to prevent the passage of water which fastener is economical to fabricate, more efficient and satisfactory in use, adaptable to a wide variety of applications and unlikely to malfunction.

A further object of the invention is to provide an improved method of fabricating a slide type fastener which in the closed condition thereof will inhibit the passage of water.

An additional object of the invention is to provide a slide type fastener which in the closed condition thereof is capable of preventing the passage therethrough of water wherein the fastener is characterized by loop or coil type connector elements webbed, filled and covered with a resilient impermeable material such as a room temperature vulcanizable silicone rubber compound which in the interlocking of the loops or coils will form a positive seal therebetween.

An additional object of the invention is to provide a method of and apparatus for the waterproofing of slide type fasteners.

Another object of the invention is to provide an improved slide type fastener capable of providing a seal of an opening to which it is applied, in the closed condition thereof, possessing the advantageous structural features, the inherent meritorious characteristics and the means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the accompanying drawings wherein is shown one but obviously not necessarily the only form of embodiment of the invention, FIG. 1 is a perspective view of a strip portion of a slide type fastener wherein the connector elements are shown to be of the coil or loop type;

FIG. 2 shows the segment of FIG. 1 in a form in accordance with the invention wherein the loops or coils providing the connector elements are webbed, filled and covered with a sealant material in accordance with the invention;

FIG. 3 is a plan view of a slide type fastener in accordance with the invention, in a closed condition thereof;

FIG. 4 is a sectional view taken on line 4—4 of FIG. 2;

FIG. 5 is a sectional view taken on line 5—5 of FIG. 3.

FIG. 6 is a view similar to FIG. 1 wherein the coils or loops of the fastener element incorporate a resilient cord for sealing purposes;

FIG. 7 is a diagrammatic view, in side elevation, illustrating a preferred method of waterproofing a slide type fastener in accordance with the invention; and FIG. 8 is a cross sectional view taken substantially along the line 7—7 of FIG. 6.

Like parts are indicated by similar characters of reference throughout the several views.

In a slide type fastener in accordance with the invention, the assembly thereof is comprised, conventionally, of two strips each including a tape-like segment 10 of flexible cloth-like material having interconnected therewith and extending from one longitudinal edge thereof a coil 12. The coil 12 forms a series of longitudinally and equidistantly spaced loops 16. In this respect it is to be understood the invention is not concerned primarily with the method of forming the loops 16 or the nature of their connection along one edge of the tape 10 but rather with the fact that the projected portions of the loops form connector elements in the closure of a slide fastener assembly so provided.

In the instance illustrated, the coil 12 is connected to the tape 10 by sewing, the stitches being applied over the coils in adjacent spaced relation to what may be regarded as the inner ends thereof. The arrangement is such to place the major portions of the loops in an outwardly projected relation to what may be regarded as an outer marginal edge 18 of the tape.

It will be understood that a complete slide type fastener includes a pair of the tapes 10 arranged in a side by side relation with the coils 12 thereof mounting in respectively opposing adjacent relation and with the corresponding loops 16 of the respective coils being in a longitudinal offset or alternating relation to one another. Attention is directed to the fact the outermost or relatively free ends of the loops are flattened at 20 to form enlargements thereof in a sense axially of the coil of which it forms a part. This enlargement 20 is commonly referred to as a scoop. In effecting a closure of the slide fastener, the loops 16 on respective tapes are caused to interdigit so as to have, by reason of the scoops, an interlock and interfit with one another. This interlock and interfit is under the control of a slide member 21 of a conventional nature. In this respect, the innermost and remote extremities 14 of the loops 16 on the tapes 10 provide tracks for the slide member. Conventionally, as the slide member is moved longitudinally of the tracks on the paired coils 12, the projected loop portions, including the scoops 20, are pressurized into their interfit and interlocking relation.

It is noted that to this point in time the structure described is conventional and absent the invention will form a seam which to a casual inspection may appear impenetrable. However, it is inherent in the conventional construction described that in the bringing together of the loops 16 there is in fact a spacing between the portions of the adjacent loops, even in their interengaged positions. As a result, the seam which they form has numerous openings through which water may readily pass. It will be obvious, of course, that in stitching to fasten the coils to the tapes that sewing holes result through which water or other liquid may pass and the tape itself is normally and inherently porous.

On applying the improvements of the invention, the tapes 10, coils 12, and loop portions 16 thereof will be modified, as illustrated in FIGS. 2 through 4 of the drawings, to be webbed, filled and covered with a resilient sealing material, preferably in the nature of a room temperature vulcanizable silicone rubber compound. This type of material is available in a variety of forms and has a natural adhesive and cohesive nature and a rubber-like resilience. It is preferably applied in a relatively liquid form and when applied tends to bridge and fill all openings, crevices or voids in exposed surfaces. It will be seen from FIGS. 2 through 4 of the drawings that in accordance with the invention a resilient sealing material such as a room temperature vulcanizable silicone rubber compound has been applied to the tapes 10, the coils 12 and their loops 16 so as to web and fill the loops 16, within the frame thereof and outwardly thereof to the extent of the scoops 20 and to coextensively coat the loops and the coil and to fill all openings, crevices and voids in the exposed surface portions of the tapes 10. As a result, the tapes 10 are effectively rendered impervious to moisture and in a closure of the slide fastener to effect an interdigiting of the loops on the adjacent tapes the webbing, filling and covering material embodied on the loops will be placed under compression. This material has a natural adhesive and cohesive nature and a rubber-like resilience. As a result, the material on the loops projected from the adjacent tapes 10 will seal together under compression and be expanded and projected to the extent that the slide fastener assembly, in a closed condition, will effectively block the passage of water, even when applied under turbulent conditions and under considerable pressure.

The nature of the material applied to the coils 12 and the tapes 10, identified in the drawings by the numeral 24, is such that upon an opening of the fastener through the medium of its slide control member and the disengagement of the respective webbed, filled and coated loops 16 on respective tapes the material 24 will expand and effect an immediate and quick separation of the loops, even though covered, webbed and filled as indicated.

As a sealant material used herein, silicone compounds have certain advantages in respect to their availability, low cost and ease of application. Certain vinyls, thermoplastics and rubbers may be used, to the extent that they are available, provided that they have the same properties of adherence and webbing of the coils and have the capacity to seal in the manner described.

There are several methods by which the material 24 may be applied to the slide fastener assembly. A preferred method is illustrated in FIGS. 7 and 8 of the drawings. In this instance the drawings illustrate a slide fastener assembly comprised of a pair of tapes 10 the adjacent edges of which mount coils 12 including projected loops which as described in the first instance, in reference to FIG. 1 of the drawings, interfit and interlock due to the relatively offset positions of the loops when the coils are pressed together by operation of the slide member provided for opening and closing the fastener assembly. In this closed position of the slide fastener, with the two parts thereof in mating relation, the fastener is moved over the working surface of a table 32 under the influence of a capstan device 30. It is to be understood in this respect that zipper type structures are originally provided in rolls of considerable length and later cut to the size required to fit their intended application. Thus, the procedure illustrated contemplates that once the lead end of a roll is engaged by the capstan 30, the zipper assembly will be continuously drawn over the table 32 until its trailing end passes the capstan. In any event, the capstan serves as a medium to draw the zipper type fastener assembly under and through a shoe type structure 34.

The shoe structure 34 is formed as an axially extended, generally rectangular, frame which, in a sense transverse to the line of movement of the zipper assembly on the table 32, has the shape of an inverted "U". As so formed, the shoe 34 includes a pair of transversely spaced dependent leg portions 36 and 38 positioning generally perpendicular to and terminating in an adjacent closely spaced relation to the top of the table 32. Suitable supports (not shown) are provided for the shoe 34 to maintain a spacing between the lower ends of its legs 36 and 38 and the table top sufficient to pass therebetween the remote edge portions of the inter-connected tapes 10 of a zipper assembly while the coils 12 thereof pass between and are laterally contained by the leg portions in a manner believed obvious from FIGS. 7 and 8 of the drawings. Under such conditions, as the capstan draws the zipper assembly to and through the shoe 34, the inner portions of the interconnected tapes 10 and their connected and interlocked coils 12 will bridge the lower ends of the legs 36 and 38 to form, with the shoe 34, a chamber 46 which is open to its respective ends. The upper or bridging portion 40 of the shoe 34 has a central aperture 42. The latter is rimmed by a suitable adapter to which is interconnected a discharge end of a tube 44. The tube 44 has a direct connection with a tank 48 containing a supply of room temperature vulcanizable silicone rubber compound in a liquid form. Interposed in the line of the tube 44 is a conventional metering device 50 the purpose of which shall soon become obvious.

Below the shoe 34 and the zipper structure moved thereunder, the table 32 is provided with an opening or slot 52 rimmed by a suitable adapter to which is coupled one end of a conduit 54. The opposite end of conduit 54 is connected to a vacuum producing pump (not shown).

In accordance with the process of the invention, on operation of the vacuum producing pump a suction effect is produced reflected in the chamber 46. Sufficient power is applied thereby to induce the movement of the liquid room temperature vulcanizable silicone compound from the tank 48, past the metering device 50, to the extent determined by its setting, and into and through the chamber 46. As the liquid material is drawn through the chamber 46 it will be caused to pass about and over the coils 12 and loops 16 thereof and between said loops and to and through the portions of the adjacent tapes 10 which lie between the legs 36 and 38 of the shoe 34. The nature of the flowing liquid is such that it will inherently cover, adhere to and web and bridge the openings within the loops 16, as well as fill and cover the underlying tape portions. Excess liquid will be drawn through the zipper assembly portion within the area between the legs and outwardly through the underlying slot 52 and conduit 54 for recovery and return to the tank 48. Of course, the zipper assembly is continuously moved and in the course of movement from the shoe 34, the liquid commences to cure and swell to some extent in the process of the commencing of its drying on the coils 16 and the tape portions 10 with which it has made contact. The eventual and net result is a bonding of the material as a webbing, covering and filler of the zipper portion with which it has made contact.

Where desired, the curing process may be expedited by running the coated zipper assemblies through a humdity and temperature control chamber as it is moved from the shoe 34. The curing can also be expedited by separating the zipper assembly into two halves to speed curing and then rejoining the halves for spooling and packing. In any event the process can be made fully continuous.

The coated webbed and filled zipper structure can later be cut to desired length, as may be necessary for the intended application.

It is noted that on separating the interlocking coils 12 which have been coated and webbed, without undue delay, it has been found that each of the coils is left with its own adherent covering and webbing which relatively expands in the curing process to a degree that on closing the respectively interlocking coils together once more there is a compression of the coating and web material between the coils which produces a tight impermeable seal through which liquid cannot pass. Repeated opening and closing of such a zipper unit produces no perceptible wear or deleterious effect on the coated material. Attention is directed to the fact that in the coating, webbing and filling process in which the liquid RTV material is drawn through the coils 12, their loops 16, and underlying tape portions, the remote edge portions of the interrelated tapes are not subjected to an application of the liquid material. This is to enable that such remote portions may be adhesively attached to material forming edges of an opening in a garment, case or the like by a conventional sealing process which will eliminate any possible leakage problems in these areas. Since such a sealing process forms, per se, no part of the present invention, and is known in the art, it will not be further described.

When the slide type fasteners above described are cut to size, tape extensions are fixed and these tape extensions are immersed in the appropriate adhesive with the remote edges of the tapes 10 which have not been coated in the process above described and insures that in application of the zipper in an opening in a garment or casing of some sort that the seal about the zipper is complete and this together with the formation of the zipper as described, in accordance with the invention, guarantees a complete application of a slide fastener or zipper which precludes the passage of liquid in the area thereof. The material which may be used on the tape extension as well as the remote edges of the tapes 10 is preferably in the nature of a plastisol which is a liquid vinyl.

Attention is again directed to the fact that in the original interdigiting of the loops 16 and their scoop portions 20 there is a space therebetween which affords passage of the room temperature vulcanizable silicone compound or its equivalent as applied in accordance with the invention. In its liquid adherent form the silicone compound webs not only the loops 16, within the planes thereof, but has an expanded lateral application as determined by the expansion of the scoops 20, fanning outwardly in the area thereof. This contributes to the complete seal enabled as the liquid material dries and expands in a curing process. The material is so adherent to the loops 16 that when the coils 12 are separated each of the respective loops of the respective coils comes away fully covered with a spongy-like substance which affords a resilient compressible layer of sealing material which compresses and expands with each closing and opening of the invention slide fastener. The coils per se will be so protected in such an environment as to give them a considerable longer useful life than now contemplated.

No particular reference need be made to the metering device 50 except to indicate that the metering will depend upon the lineal speed of the slide type fastener as it is drawn through the shoe 34.

FIG. 6 of the drawings indicates a less preferred embodiment of the invention which nevertheless can in some instances afford a waterproof closure of a slide fastener for certain applications. The showing of one-half of a slide fastener in FIG. 6 is identical to the showing in FIG. 1 in respect to the tape 10 and the interconnected coil 12. Like parts are indicated by similar numerals, with the addition of a "prime" symbol. In the basic segment of a slide fastener as here illustrated, it may be seen that a thread or cord-like item 17 is drawn through and fills the projected portions of the loops 16' of the coils 12'. The cord or thread 17 may be made of vinyl, rubber, silicone or any resilient compressible material that will fill the major portion of the void defined by the loops 16'. It will be seen that on interconnection of a pair of adjacent tape segments 10' and their interconnected coils 12', of the nature shown in FIG. 6, that upon the interdigiting of the loops 16' on the respective tapes that the resilient cord 17 will be compressed and bulged to fill all spaces therebetween and within the confines of the loops 16'. A reasonably satisfactory waterproof seal will be achieved in this process which, as indicated, could be satisfactory for certain less critical applications. Of course, if desirable and necessary there could be further added a superposed coating of a material such as a room temperature vulcanizable silicone compound of the nature previously described to fill any voids which may exist in the related tapes.

From the foregoing it will be clear that the invention provides, in its preferred embodiment, a means and method for achieving a watertight slide fastener closure. The slide fastener of the invention is distinctive by reason of its economy and long life and by appropriate modification of the sealing compound, which can be easily made, one can adapt the fastener to suit a great variety of applications.

While the waterproofing material employed has been indicated, by way of preference, to be a room temperature vulcanizable silicone compound, with proper techniques and machinery various pourable vinyls can be similarly utilized, as well as other thermoplastics and rubbers. As indicated herein, the invention is particularly applicable to zippers wherein the interdigiting or interconnecting portions have a loop form.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed are defined as follows:

1. A process for making a waterproof slide fastener device which includes a tape portion one edge of which mounts connector means formed to achieve an interdigiting connected relation to related connector means on a similar tape portion comprising the steps of providing a tape portion at one edge thereof with connector means in the form of projected segments having a loop-like configuration, moving a flow of liquid sealing material past said loop-like segments and to envelope said loop-like segments to web the said loop-like segments where said segments are connected to the tape, providing thereby that on interdigiting connector means of a pair of tape portions so provided, in a side by side arrangement, said sealing material will produce a complete seal across said tape portions in the area of said loop-like segments by means of the webs thereof.

2. The process as set forth in claim 1 characterized in that said liquid material is applied by inducing a flow thereof over and past said loop-like segments and through portions of the tape material which may lie thereunder under the influence of applied suction.

3. The process as set forth in claim 1 characterized in that said tape portion is moved in one direction while said liquid material is applied to said loop-like segments by inducing the flow thereof past and in a direction transverse to the moving tape.

4. A process as set forth in claim 1 characterized in that said liquid material is applied under pressure to force it over and past said projected segments of loop-like form to coat and fill voids in the same.

5. A process for making a waterproof slide fastener device as in claim 1 wherein two tape portions including said connector means of loop-like configurtion are placed in side by side relation with said segments in an interdigited relation and said liquid sealing material is applied simultaneously thereto and caused to move in a pressured flow past and to said loop-like segments to envelope said loop-like segments and to simultaneously coat the tape portions in connection therewith, the arrangement providing that the liquid sealing material will inherently cover, adhere to and web the openings within said segments of loop-like configuration where the connector means are connected to the tape as well as fill and cover the connected tape portions, said liquid sealing material being of a composition to expand to some extent on drying thereof on said segments and across said segments and the connected tape portions.

6. A process for making a waterproof slide fastener device as in claim 5 including the step of separating the respective tape portions and their connected loop-like segments after applying said liquid sealing material, leaving each of said tape portions and the connected loop-like segments with its own adherent covering and webbing, and expanding said material in a curing process to a degree that on closing of the respective loop-like segments on respective tapes once more there is compression of the covering and webbing so provided producing a tight impermeable seal between said tape portions, which are made impermeable also by reason of the application of said liquid material.

7. A process as set forth in claim 5 carried out by moving said tape portions and mounted connector means through a chamber in one direction and at a selected station in said chamber moving said liquid material therethrough in a sense perpendicular to the moving tape and said connector means thereon whereby to achieve an essentially complete webbing-/and coating of said projected segments of loop-like form in passage thereof through said station and thereafter drying and curing said material so applied during the continuing movement of said tape portions and mounted connector means subsequent to passage thereof through said chamber.

8. A process as set forth in claim 7 characterized by effecting the application of said liquid material by applying suction to draw said liquid material to and through the bottom of said chamber.

9. The process as set forth in claim 5 characterized by simultaneously moving a related pair of said tape portions and their mounted connector means through a chamber in a side by side relation, directing said liquid material to the chamber through a top portion thereof while simultaneously applying suction to said chamber at the bottom portion thereof whereby to draw said liquid material through said chamber to essentially fully web and coat said projected segments of loop-like form and the tape portions to which they mount in the passage of said material thereby.

* * * * *

UNITED STATES PATENT AND TRADEMARK OFFICE

CERTIFICATE OF CORRECTION

PATENT NO. : 4112150

DATED : September 5, 1978

INVENTOR(S) : Michael A. Brown and Steven F. Shade

It is certified that error appears in the above-identified patent and that said Letters Patent are hereby corrected as shown below:

Col. 9, lines 9 and 10, delete -- "-/" --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*